United States Patent [19]

Deutsch

[11] 4,387,622

[45] Jun. 14, 1983

[54] MUSICAL TONE GENERATOR WITH INDEPENDENT TIME VARYING HARMONICS

[75] Inventor: Ralph Deutsch, Sherman Oaks, Calif.

[73] Assignee: Kawai Musical Instrument Mfg. Co., Ltd., Hamamatsu, Japan

[21] Appl. No.: 284,744

[22] Filed: Jul. 20, 1981

[51] Int. Cl.[3] ..... G10H 1/06

[52] U.S. Cl. ..... 84/1.22; 84/1.01; 84/1.11; 84/1.19

[58] Field of Search ..... 84/1.01, 1.11, 1.19, 84/1.21, 1.22

[56] References Cited

U.S. PATENT DOCUMENTS

| | | | |
|---|---|---|---|
| 3,956,960 | 5/1976 | Deutsch | 84/1.19 |
| 4,085,644 | 4/1978 | Deutsch et al. | 84/1.01 |
| 4,211,138 | 7/1980 | Deutsch | 84/1.01 |

*Primary Examiner*—J. V. Truhe
*Assistant Examiner*—Forester W. Isen
*Attorney, Agent, or Firm*—Ralph Deutsch

[57] ABSTRACT

In a musical instrument having one or more tone generators in which a plurality of data words corresponding to the amplitudes of a corresponding number of evenly spaced points defining the waveform of one cycle of a musical signal are transferred sequentially from a note register to a digital-to-analog converter in repetitive cycles at a rate proportional to the pitch of the tone being generated, apparatus is provided for producing tones having independent time-varying harmonic components. A recursive algorithm is implemented which approximates prespecified harmonic-time curves by piecewise segments of exponential functions. Only a small number of stored curve parameters are required to generate the harmonic-time scale factor for a set of harmonic coefficients.

11 Claims, 9 Drawing Figures

MUSICAL TONE GENERATOR WITH INDEPENDENT TIME VARYING HARMONICS

BACKGROUND OF THE INVENTION

1. Field of the Invention

This invention relates to electronic tone synthesis and in particular is concerned with a means for generating tones with time varying harmonic strengths.

2. Description of the Prior Art

An elusive goal in the design of electronic musical instruments is the ability to realistically imitate the sounds of conventional acoustic type orchestral musical instruments. The best results have been obtained for electronic musical instruments which imitate wind-blown pipe organs and harpsichords. The principal reason for obtaining good imitative results for these instruments is that they are essentially mechanical tone generators. The tone generation mechanism is automatic in operation and the musician needs only to actuate on-off switches.

It has long been recognized that with the notable exception of conventional organ tones, almost all tones produced by musical instruments exhibit tone spectra which are time variant in composition. In recent years there has been considerable research devoted to the detailed nature of the sounds produced by acoustic orchestral musical instruments. The application of large digital computers to this research has yielded large amounts of spectral data. It has generally been determined that the various harmonics, which constitute the tonal spectrum of a musical instrument, vary with time from the onset until the cessation of tone production. The individual harmonics have time variant strength patterns which are essentially independent of each other.

Musical tone synthesizers have been implemented which use stored tabular values of the individual harmonic time variations to synthesis tones. Frequently the synthesized tones cannot easily be distinguished from those produced by the parent musical instrument.

The large amount of data that must be stored to individually control the time variant behavior of a set of harmonics is a serious detriment to a practical implementation of a musical tone synthesizer which creates tones by computing a Fourier transform using the set of harmonics. Attempts have been made to reduce the quantity of stored data by resorting to the use of a series of straight line segments to approximate the amplitude-time function curves for each member of the set of harmonics that characterize a selected musical tone. The practical problem that must be solved in a linear approximation process is to choose the smallest number of individual line segments for the approximation to a curve such that a "realistic" tone is produced while reducing the amount of data for the line segments that must be stored for each of the harmonics used to synthesize the musical tone.

A survey of various algorithms for approximating curves with linear piecewise segments is contained in the technical article: Strown, J., "Approximation and Sytatic Analysis of Amplitude and Frequency Functions for Digital Sound Synthesis." *Computer Music Journal*, Vol. 4, No. 3 (1980) pp 3–24.

While the use of piecewise linear segments to approximate a function is a widely used technique, it is by no means the only available technique nor is it even the best method to use in any arbitrary situation. The choice of an approximating function is influenced by the allowable approximation error and the practical problem arising from generating the selected approximating function from a minimal data set of curve generating parameters. For a linear line segment, the approximation is determined by specifying the slope of the line and the starting point. The total number of required line segments can only be determined by examination of the given function which represents the time variation of a harmonic component of the musical tone. Each line segment requires a data set comprising the line slope, starting point, and time at which the line is to be used in the function approximation.

If the approximate shape of the harmonic time function is known, and is not completely arbitrary, then frequently the amount of stored data for the approximation can be reduced in comparison to that required for a piecewise linear approximation. Such a curve approximation system is described in U.S. Pat. No. 4,211,138 entitled "Harmonic Formant Filter For An Electronic Musical Instrument." The patent describes a curve synthesis technique in which a tone formant filter is constructed by adding a number of standard resonant curves together after displacing the resonant frequencies of the individual component resonant curves.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During a computation cycle, a master data set is created by implementing a discrete Fourier transform using a time variant set of harmonic coefficients which characterize a preselected musical tone. The computations are carried out at a fast rate which may be nonsynchronous with any musical frequency. At the end of a computation cycle, the master data set is stored in a memory.

Following a computation cycle, a transfer cycle is initiated during which the stored master data set data are transferred to preselected members of a multiplicity of tone generators. The output tone generation continues uninterrupted during the computation and transfer cycles. The transferred data is stored in a note register contained in a tone generator.

The master data set stored in the note registers in each of the preselected members of the multiplicity of tone generators is sequentially and repetitively read out of storage and converted to an analog musical waveshape by means of a digital-to-analog converter. The memory addressing rate is proportional to the corresponding fundamental frequency of the musical pitch associated with a tone generator.

The time variant harmonic coefficients are generated by means of a recursive calculation in which the present value is obtained by a simple scaling of the previous value. A selection is made from four recursive calculation types using stored curve select parameters and starting values. The selection of a calculation type is made at a time determined by a stored segment number and an adjustable formant clock.

An object of the present invention is to produce musical tones with time variant harmonic components using a recursive algorithm to generate the individual time variant harmonics.

It is a further object of the present invention to approximate a time variant harmonic function curve by a series of piecewise exponential functions generated by a recursive algorithm.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed to a time variant harmonic generator subsystem incorporated in a musical tone generator of the type that synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all elements of the system which are described in the referenced patent are identified by two digit numbers which correspond to the same numbered elements appearing in the patent. All system element blocks which are identified by three digit numbers correspond to elements added to the Polyphonic Tone Synthesizer to implement the improvements of the present invention to produce musical tones having time variant harmonic components.

Figure 1:
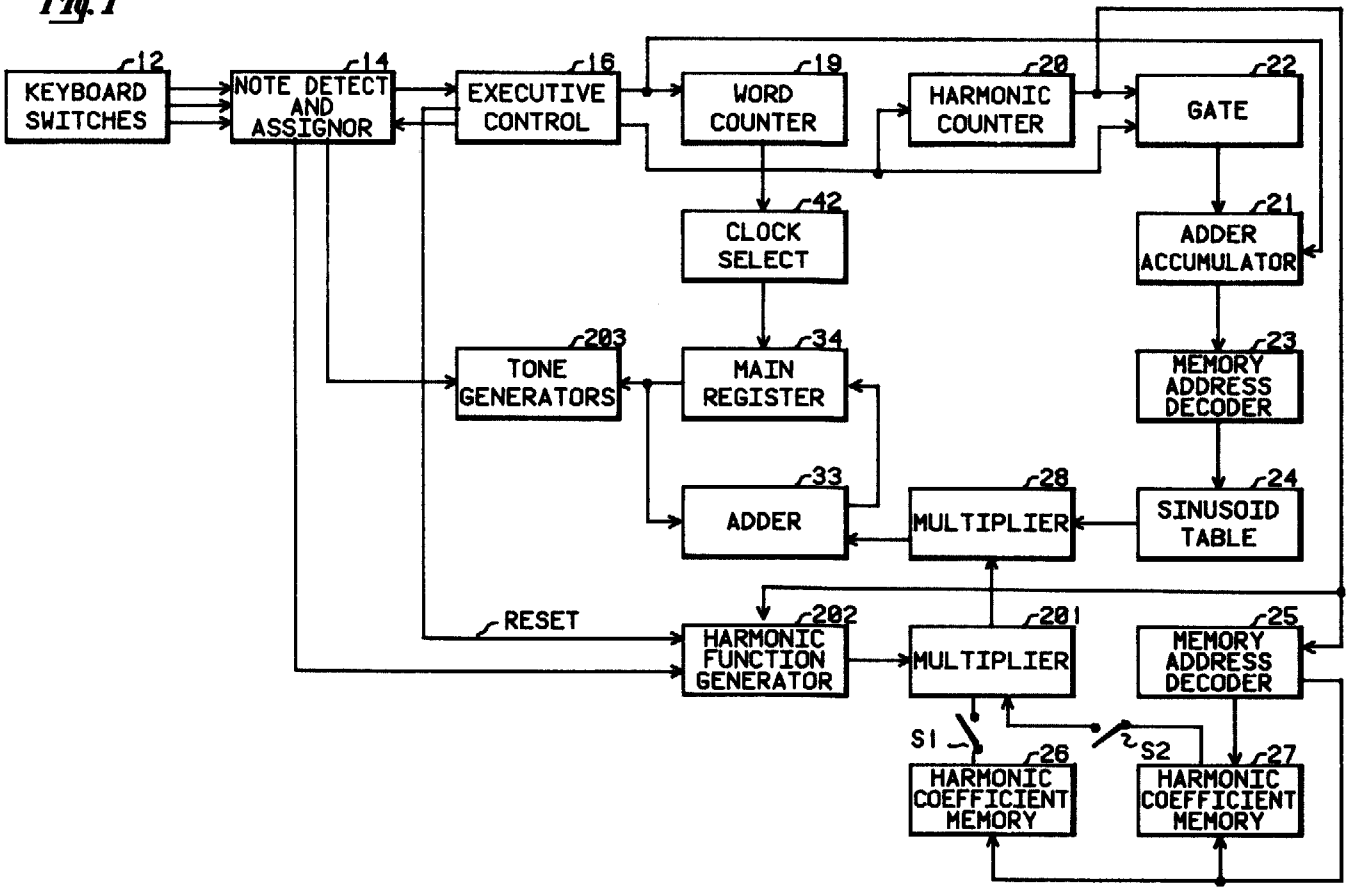
FIG. 1 is a schematic block diagram of an embodiment of the invention.

FIG. 1 shows an embodiment of the present invention which is described as a modification to the system disclosed in U.S. Pat. No. 4,085,644. As described in the referenced patent the Polyphonic Tone Synthesizer includes an array of switches contained in the block labeled keyboard switches 12 which, for example, corresponds to the conventional keyboard of an electronic musical instrument such as an organ. By depressing one or more keys on the instrument's keyboard, a note detect and assignor circuit 14 stores the note information for the keys that have been actuated and assigns each actuated keyswitch to one of twelve separate tone generators. The set of tone generators are contained in the system block labeled tone generators 203. A note detect and assignor circuit is described in U.S. Pat. No. 4,022,098 which is hereby incorporated by reference. When one or more keys on the keyboard has been depressed, or actuated, an executive control circuit 16 initiates a computation cycle during which a master data set consisting of 64 words is computed and stored in a main register 34. The 64 words are generated with values which correspond to the amplitudes of 64 equally spaced points for one cycle of the audio waveform for the musical tone produced by the tone generators. The general rule is that the maximum number of harmonics in the tone spectra is no more than one half of the number of data points in one complete cycle, or equivalently the number of data points comprising the master data set.

At the completion of a computation cycle, a transfer cycle is initiated during which the master data set stored in the main register 34 is read out and transferred to note registers which are contained in each member of the set of tone generators 203. These note registers store the 64 data words which correspond to one complete cycle of a preselected musical tone. The data words stored in the note registers are read out sequentially and repetitively and transferred to a digital-to-analog converter which converts the digital data words into an analog musical waveshape which is converted into a sound by a sound system consisting of a conventional amplifier and speaker system. The stored data is read out of each note register at a rate corresponding to the fundamental frequency of the note corresponding to an actuated keyswitch to which a tone generator has been assigned.

As described in the above-identified U.S. Pat. No. 4,085,644, it is desirable to be able to continuously recompute the master data, which resides in the main register 34, during a sequence of computation cycles and to load this data into the note registers while the actuated keys remain depressed on the keyboard. This is accomplished without interrupting the flow of data points to the digital-to-analog converter at the read-out clock rates.

In FIG. 1, word counter 19 counts timing pulses modulo 64 as furnished by the logic system's master clock. The harmonic counter 20 counts modulo 32 which corresponds to the maximum number of harmonics consistent with a master data set having a total of 64 data points. The harmonic counter 20 is incremented each time that the word counter 19 is returned to its initial, or minimal, count state. The count state of the harmonic counter 20 is transferred via gate 20 to the adder accumulator 21 each time that the word counter 19 is incremented. The memory address decoder 23 addresses trigonometric function values stored in the sinusoid table in response to the contents of the adder-accumulator 21.

During a computation cycle, executive control 16 causes the word counter 19 to be incremented by 32 full counting cycles of 64 counts per cycle.

Sets of harmonic coefficients $c_q$ are stored in the harmonic coefficient memories 26 and 27. The tone switches, or stops, S1 and S2 are used to select the desired set of harmonic coefficients which are used to generate the corresponding tone colors produced by the tone generators 203.

The harmonic coefficients are addressed out from the harmonic coefficient memories 26 and 27 in response to the state of the harmonic counter 20. This count state is converted to a memory address format by means of the memory address decoder 25.

The harmonic coefficients $c_q$ selected by means of the tone switches S1 and S2 are multiplied by scale factors furnished by the harmonic function generator 202 by means of the multiplier 201. The detailed description of the harmonic function generator 202 is presented below.

The scaled harmonic coefficients produced by the multiplier 201 are multiplied by the sinusoid values addressed out from the sinusoid table 24 in the multiplier 28 in the manner described in the above referenced U.S. Pat. No. 4,085,644. The output data from the multiplier 28 are added pointwise to data read out of the main register 34 by means of the adder 34 and the result is stored in the main register 34 at an address corresponding to the count state of the word counter 19. At the end of the computation cycle, a master data set corresponding to the preselected musical tone will have been computed and stored in the main register 34.

An examination of experimentally obtained harmonic-time variation curves for tones produced by acoustic-type orchestral musical instruments indicate that the attack phase of the tone harmonic curves resemble segments of increasing exponential functions while the decay and release phases resemble segments of decreasing exponential functions. It is therefore a reasonable approach to approximate the harmonic-type curves by segments of exponential functions. Further reinforcement for this approach is fortified by the well-known observation that the overall tone envelope (amplitude envelope) of a musical instrument tends to have an increasing exponential function attack shape and a decreasing exponential decay shape.

An exponential function is characterized by two parameters. One parameter indicates the start point and the second parameter determines the rate of change of the function values. An advantage of using a sequence of exponential functions to approximate the harmonic-time curves for a selected tone is that in general fewer segments are needed than would be required with a piecewise approximation using straight line segments. Moreover, as described below, a simple recursion relation can be implemented to obtain the exponential function values so that the curve approximation simplicity of the exponential function is not obtained at the expense of a complex computational logic subsystem.

In U.S. Pat. No. 4,214,503 entitled "Electronic Musical Instrument With Automatic Loudness Compensation" a method is described for computing attack, decay, and release envelope scale factors by implementing a recursive relation. This patent is hereby incorporated by reference.

In the referenced U.S. Pat. No. 4,214,503 recursion relations are listed for six phases which comprise an ADSR (attack, decay, sustain, and release) envelope curve. Only four of these six phases are required for the present curve approximation technique. These phases will herein be called "shapes", or "curve types", to differentiate the word "shape" used here from the word "phase" used in the referenced patent which refers to particular regions of an ADSR envelope function.

The value of each point for the harmonic-time variation curve for any harmonic is computed according to a recursive relation $$A' = KA + N \qquad \text{Eq. 1}$$

where A is the previous amplitude value, A' is the new, or present, amplitude value, and K and N are prespecified numbers. The values of K and N vary for each of the four curve shapes. Eq. 1 defines a recursive computation. The four curve shapes are generated by implementing the following explicit forms of the basic recursion relation of Eq. 1:

$$\text{curve 1: } A' = KA \qquad \text{Eq. 2}$$

$$\text{curve 2: } A' = A'/K - M(1-K)/K \qquad \text{Eq. 3}$$

$$\text{curve 3: } A' = KA + M(1-K) \qquad \text{Eq. 4}$$

$$\text{curve 4: } A' = A/K \qquad \text{Eq. 5}$$

Figure 2:
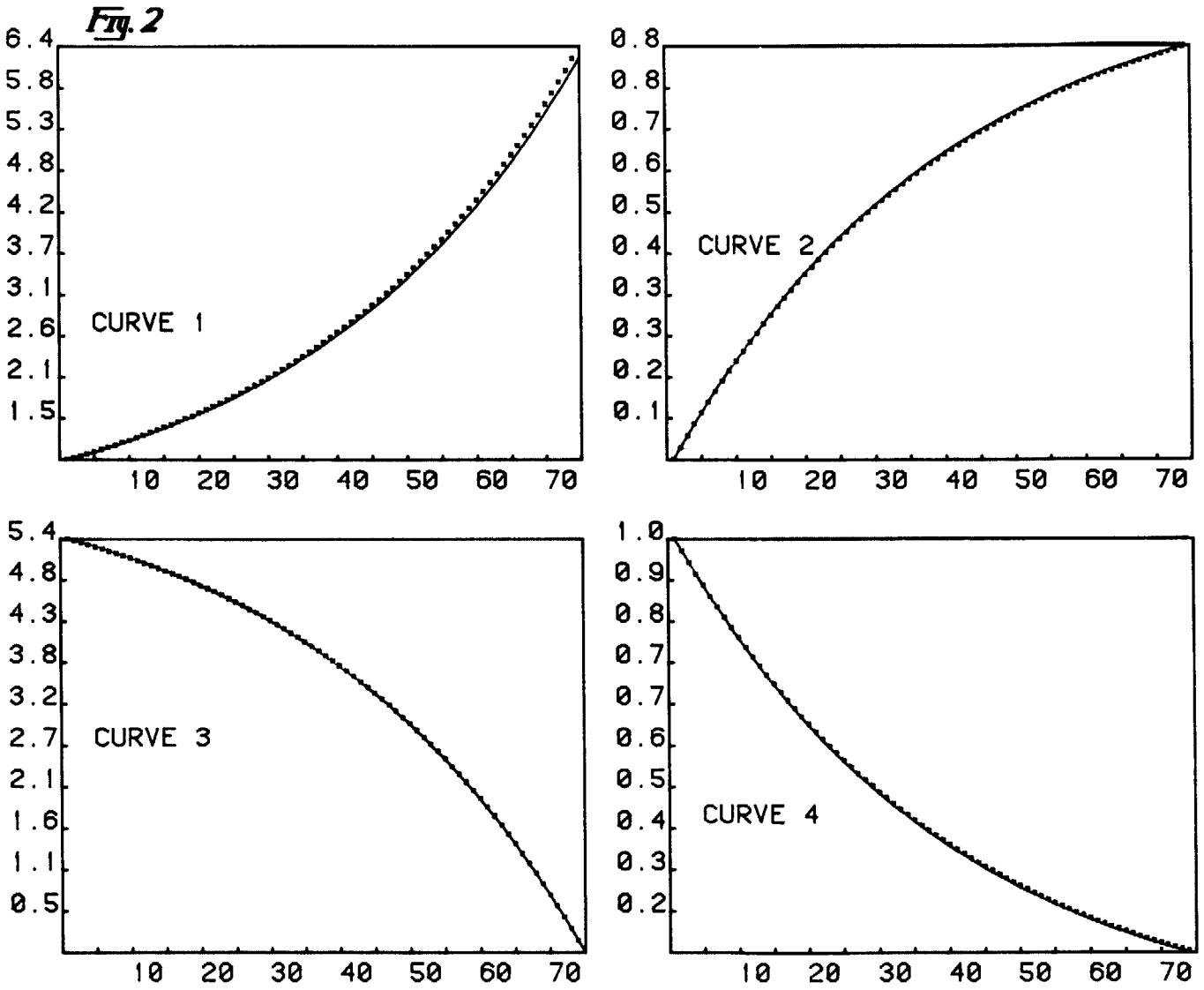
FIG. 2 illustrates the four types of approximating exponential function curves.

FIG. 2 illustrates the four curve types. While not stated explicitly in the referenced U.S. Pat. No. 4,214,503, each of the curves has an exponential shape. The x-position in each curve represents the points computed according to the corresponding recursion relations of Eq. 2 through Eq. 5 while the solid lines are computed from one of the following four corresponding exponential functions:

$$\text{exponential 1: } A = A_o \exp(BX) \qquad \text{Eq. 6}$$

$$\text{exponential 2: } A = A_o(l\text{-}\exp(-BX)) \qquad \text{Eq. 7}$$

$$\text{exponential 3: } A = -A_o \exp(BX) \qquad \text{Eq. 8}$$

$$\text{exponential 4: } A = A_o \exp(-BX) \qquad \text{Eq. 9.}$$

In these equations X is the independent curve variable, which in this case is time.

By using the equations for each curve type and the corresponding exponential, relations are obtained for the recursive curve parameters K and M. The exponential curve parameters $A_o$ and B are obtained from a selected segment of the harmonic-time curve that is chosen as the segment to be approximated by a segment of an exponential function. The parameters of the approximating exponential function are obtained by solving two simultaneous equations obtained by inserting the amplitude and time values in the exponential equation for the beginning and end points of a selected segment of the harmonic-time curve. The resulting two equations are in a transcendental form and can be numerically solved using well-known procedures such as the Newton-Raphson iterative solution technique to find the values of $A_o$ and B for the approximating exponential.

Table 1 lists the relations between the exponential curve parameter $A_o$ and B and the curve shape parameters K and N for each of the four curve shapes.

TABLE 1

| Curve Shape | K | N |
|---|---|---|
| 1 | B + 1 | O |
| 2 | $(M - A_o)/(1 - A_o - MB + A_oB)$ | $-M(1 - K)/K$ |
| 3 | $(A_o - B - M)/(A_o - M)$ | $M(1 - K)$ |
| 4 | $A/(1 - B)$ | O |

M is the maximum value for the curve shape that would be obtained by the corresponding exponential function at its asymptotic value.

Figure 3:
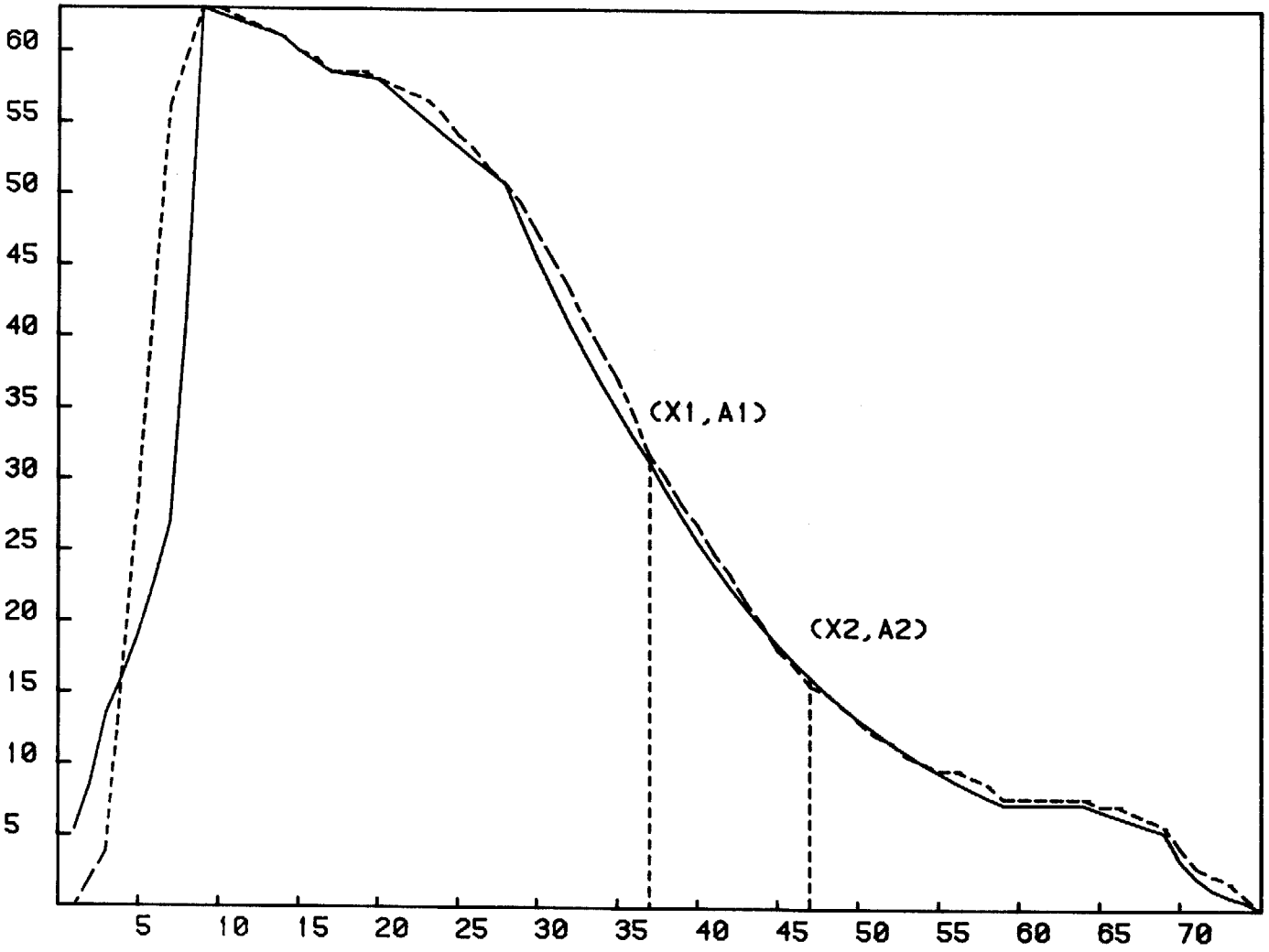
FIG. 3 illustrates the method for obtaining the approximating curve parameters.

FIG. 3 illustrates a method of obtaining the parameters for the curve shape of a selected approximation segment. The dashed-line is a graph of the time variation of the fifth harmonic for an acoustic trumpet tone. The solid lines are the result obtained by a piecewise approximation of this curve by using data generated by the recursive relations shown in Eqs. 2–5.

The method of calculating the curve parameters is illustrated for the segment occuring between the x-axis values of 25.6 and 54.9. The x-axis is labeled in arbitrary units which are related to real time intervals. The selected segment is best approximated by a curve of shape 4. This is apparent from a comparison of FIG. 3 and FIG. 4. Eq. 9 is applied to obtain the values of $A_o$ and B by solving the following system of simultaneous equations $$A_i = A_o \exp(-BX_i);\ i = 1,2 \qquad \text{Eq. 10}$$

The value of K used in Eq. 5 for the curve shape 4 is obtained from the entry of curve 4 shown in Table 1.

A similar procedure is used for each of the other curve approximating sections. The selection of the segments can be done by visual inspection of a given harmonic-time variation curve. A "best" fit is not necessary because the ear is relatively insensitive to moderate variations in the harmonic-time amplitude changes.

The approximating curve can be generated, as described below, by storing data which comprises the curve shape type, the values of the parameters K and M, and the time at which the approximation curve shape is to be used.

Figure 4:
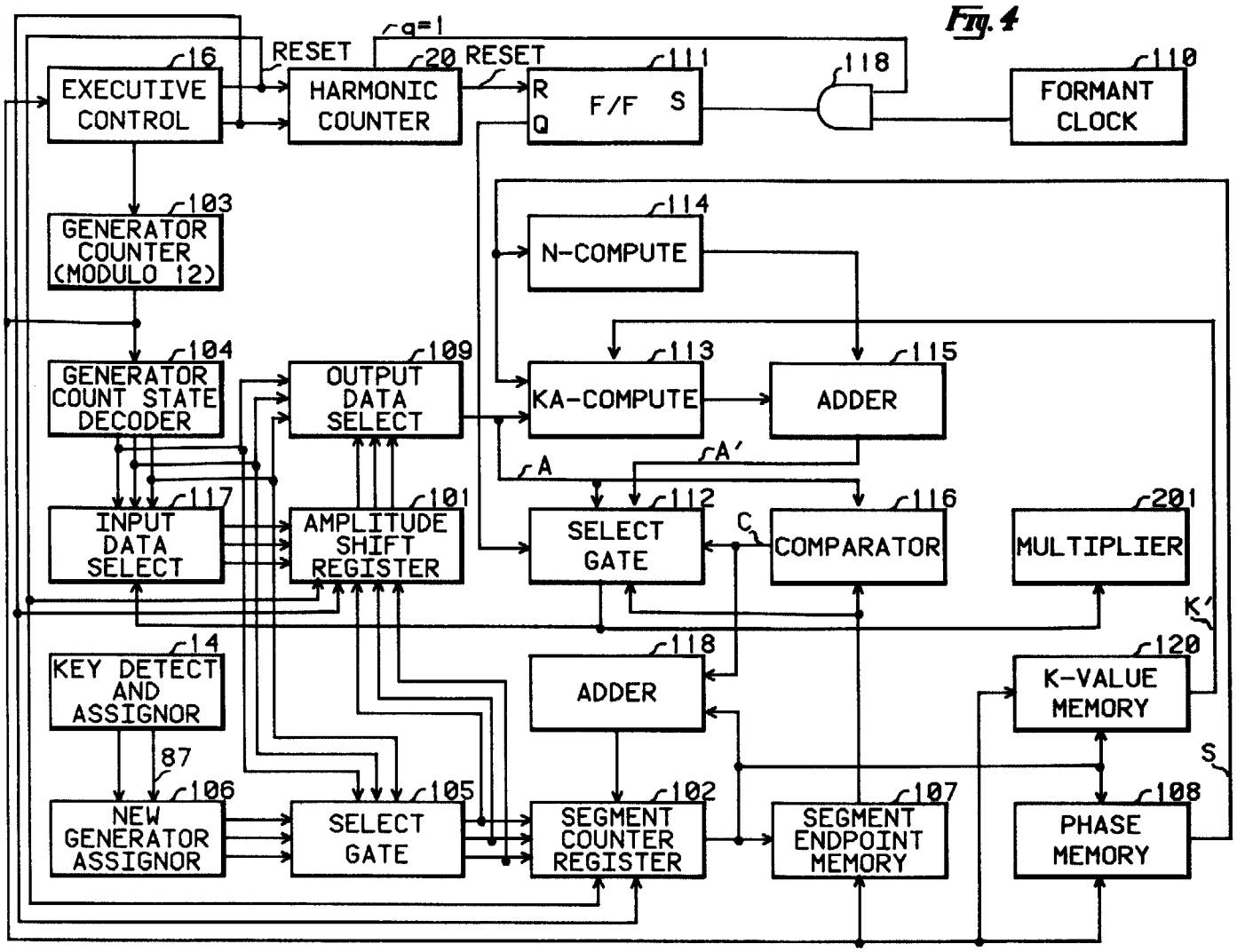
FIG. 4 is a schematic block diagram of the harmonic function generator.

FIG. 4 illustrates the detailed logic of the harmonic function generator 202 shown in FIG. 1. The harmonic variations for each of the individual harmonics are obtained by time sharing a single computation system which generates the approximating harmonic-time function curves from a stored table of curve parameter values. The computation system is essentially an improvement of the ADSR curve generation system described in the referenced U.S. Pat. No. 4,214,503.

Because the time variation effects for the tone harmonics start when a keyswitch is actuated the computation cycle and transfer cycles are implemented as a sequence for each note. That is, a computation cycle segment is implemented for an assigned tone generator. At the conclusion of this computation cycle a transfer cycle occurs in which the master data set is transferred to the assigned tone generator. Immediately following the first transfer cycle, a second computation cycle segment is implemented if a second keyswitch has been actuated (in a closed state). The second computation cycle segment is followed by a second transfer cycle in which the new master data is transferred to the second assigned tone generators. This sequence of a computation cycle segment and a transfer cycle is implemented until all the assigned tone generators have received new master data set values. At this time, the sequence is repeated starting again with the first assigned tone generator.

The amplitude shift register 101 is a set of P component shift registers each of length Q. Each component shift register corresponds to one of the tone generators contained in the tone generators 203. P is the number of these tone generators and Q is the maximum number of harmonics used during a computation cycle segment. For the preferred embodiment, Q=32.

The segment counter register 102 is also implemented as a set of P component shift registers each of which corresponds to one of the tone generators contained in the tone generators 203.

When the key detect and assignor 14 determines that a keyswitch has been actuated (keyswitch is in closed state), a signal is generated on line 87 in a manner described in the referenced U.S. Pat. No. 4,214,503. The new generator assignor 106 decodes the new signal on line 87 onto one of 12 signal lines. Each of these lines corresponds to one of the set of 12 tone generators contained in the block labeled Tone Generators 203 in FIG. 1.

The generator counter 103 is incremented by the executive control 16. Each count state of the generator counter 103 corresponds to a computation cycle segment that is allocated to the tone generator assigned to the same computation cycle segment. The generator counter 103 is implemented to count modulo 12.

The binary count state of the generator counter 103 is coded onto 12 lines by means of the generator count state decoder 104. These lines are provided as one set of input signals to the select gate 105. The select gate will provide a "1" logic state signal on one of its set of 12 output lines in response to a new note signal on line 87. In this manner the new note signal is decoded onto a signal line corresponding to the tone generator assigned to the newly actuated keyboard switch.

A "1" logic state signal on one of the P lines from the select gate 105 will initialize the corresponding shift register component contained in the amplitude shift register 101 and in the segment counter register 102.

All the shift registers contained in the amplitude shift register 101 and in the segment counter register 102 are shifted synchronously each time that the count state of the harmonic counter is incremented.

The segment endpoint memory 107 is used to store precalculated values of the amplitudes at the endpoints of the exponential segments selected to approximate a given set of 32 harmonic-time variation curves. This memory is a read only memory organized as Q memories wherein each memory has T words. T is the maximum number of exponential segments used to approximate any of the Q harmonic-time variation curves. The count state of the generator counter 103 is used to select which of the Q memories contained in the segment endpoint memory 102 will be addressed by a data word addressed out of the segment counter register 102 for the current count state of the harmonic counter 20. As previously described, data is read out of the segment counter register 102 each time that the harmonic counter 20 is incremented. The phase memory 108 is used to store a predetermined number S that determines which of the four curve types are used to approximate the preselected harmonic-time variation curves. This memory is implemented as a read only memory organized as Q memories each of which contains T data words. The count state of the generator counter 103 is used to select which of the Q memories contained in the phase memory 108 will be addressed by a data word addressed out of the segment counter register 102 for the current count state of the harmonic counter 20.

The action of the harmonic function generator 202 detailed in FIG. 4 is examined for the situation in which the tone generator, designated as $P_j$, has just been assigned corresponding to a new keyswitch closure on the keyboard. The $P_j$ shift registers in the amplitude shift register 101 and in the segment counter register 102 will be initialized. Each data word in the $P_j$ shift register in the amplitude shift register 101 is initialized to the value A=1/256. Each data word in the $P_j$ shift register in the segment counter register 102 is initialized to a zero value.

While the generator counter 103 is in count state j, the output data select 109 will select the output data from the $P_j$ shift register in the amplitude shift register 101 and the input data select 117 will transfer input data to be written into the end position of the corresponding $P_j$ shift register.

The formant clock 110 is a variable frequency clock generator for creating a sequence of time pulses. The frequency of this clock is used to control the speed at which the amplitude changes are made for each of the harmonic coefficients used to synthesize the preselected musical tone. Usually the period of the formant clock 110 is set to be less than the time required to complete 12 computation cycle segments. For example, if the master logic clock runs at a frequency of 1 Mhz, a computation cycle segment has a time length of $64\times32\times10^{-6}=2.048$ miliseconds. The formant clock preferably should have a period less than $488\times12=40$ Hz. If the harmonic counter 20 is in its initial state corresponding to the harmonic number $q=1$, then the AND-gate 118 will transfer a timing signal from the formant clock 110 which will set the flip-flop 111. This flip-flop will be reset by a RESET signal generated by the harmonic counter 20 when it is incremented and reset to its initial state due to its modulo 32 counting implementation. The flip-flop 111 acts as a latch to store a logic state.

A new amplitude A' is computed from the current amplitude A read out of the $P_j$ shift register in the amplitude shift register 101 which has been selected by the output data select 109 by means of the N-compute circuit 114 and the KA-compute circuit 190. The N-compute circuit 114 and the KA-compute circuit 113 in combination with the adder 115 compute the new amplitude value A' according to one of the four curve types of Eqs. 2–5 which is selected by the current value of S that is addressed out of the phase memory 108. The detailed operation of the N-compute circuit 114 and the KA-compute circuit 113 are described later.

The present stored amplitude A and the new calculated value of A' are both provided as data input signals to the select gate 112. When the flip-flop 111 is not in its set condition so that the output state is Q="0", the select gate 112 will select the present amplitude A to be transmitted to the input select gate 117 and to the multiplier 201. The amplitude value transmitted to the input data select gate 117 will be selected and written into the endposition of the $P_j$ shift register in the amplitude shift register 101.

The current endpoint amplitude addressed out from the segment endpoint memory 107 is compared with the current amplitude value A furnished by the output data select 109 by means of the comparator 116. If the absolute value of the difference between the amplitude A and the endpoint amplitude is greater than a prespecified value, the comparator 116 will transmit a C="0" logic state signal to the select gate 112. If the signal C="0" and the state of the flip-flop 111 is Q="1" the new amplitude value is selected by the select gate 112 to be transferred to the input data select 117 and the multiplier 201.

If the comparator 116 finds that the absolute value of the difference between A and the endpoint value is less than the preselected comparison value, a logic signal C="1" is generated. In response to a C="1" signal, the select gate 112 will select and transfer the endpoint value read out of the segment endpoint memory 107 to the input data select 117 and the multiplier 201.

In response to a C="1" signal, the adder 118 will increment the count state stored in the $P_j$ shift register contained in the segment counter register 102. This incrementing action causes the system to start computing amplitude values for the next approximating curve segment.

The time changes for the amplitude values are controlled by the frequency of the formant clock which is advantageously set at a frequency whose period is less than that of the time required for P computation cycle segments.

After the harmonic counter 20 has been incremented for the full range of 32 harmonics, the generator counter 103 is incremented so that the current amplitudes are computed for the $P_{j+1}$ tone generator in a fashion analogous to that previously described for the $P_j$ tone generator.

The K-value memory 120 is used to store values of the curve parameters K, 1/K, and M according to the relations displayed in Table 1. This memory is implemented as a read only memory organized as P memories each of which contains T data words. The count state of the generator counter 103 is used to select which of the P memories contained in the K-value memory 120 will be addressed by a data word addressed out of the segment counter register 120 for the current count state of the harmonic counter 20. It is convenient to code the values of K, 1/K, and M as a single extended word and to use select gates in the system logic element to separate the three quantities.

Figure 5:
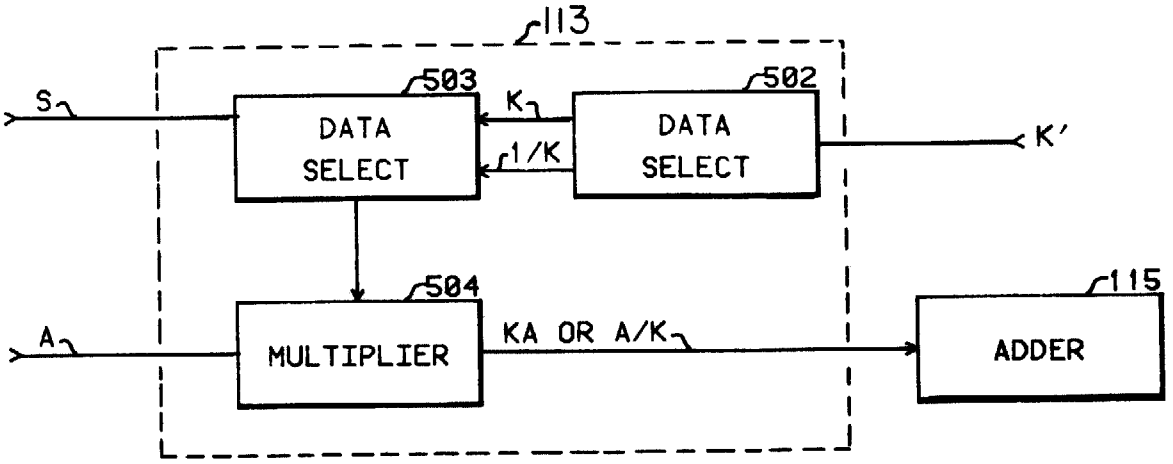
FIG. 5 is a schematic diagram of the KA-compute circuit of FIG. 4.

The KA-compute 113 logic is shown in FIG. 5. The data select gate 502 decodes the first set of significant bits of the data word K' addressed out from the K-value memory 120 into the data value K and the second set of significant bits are decoded into the data value 1/K. The multiplier 504 multiplies the present amplitude value A from the output data select 109 with either the value K or the value 1/K. The selection made of K or 1/K by the data select 503 depends upon the input curve type parameter S. Inspection of Eqs. 2–5 shows that K is selected for curve types 1 and 3 while 1/K is selected for curve types 2 and 4.

Figure 6:
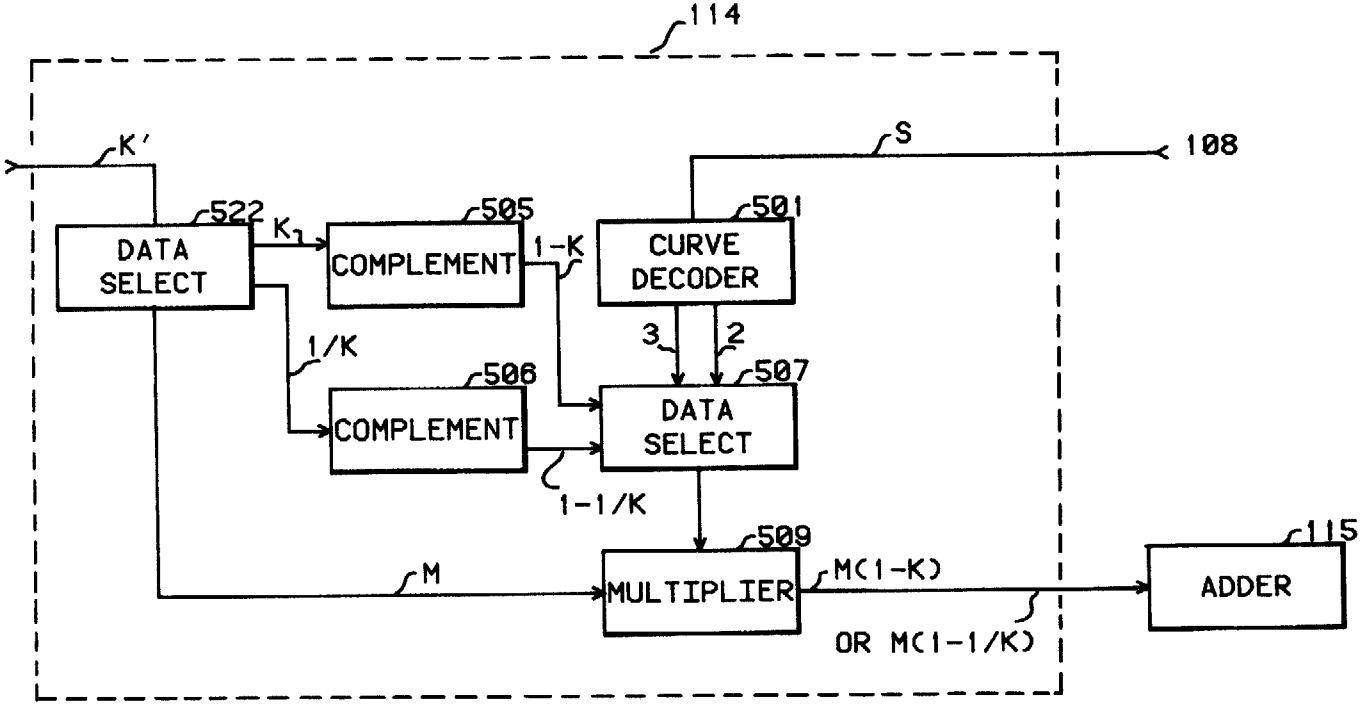
FIG. 6 is a schematic diagram of the N-compute circuit of FIG. 4.

The N-compute 114, shown in FIG. 6, is used to compute the second terms in Eq. 3 and 4 for curve types 2 and 3. The data select 522 decodes the input data word K' from the K-value memory 120 into the three curve parameters K, 1/K and M. The values of K and 1/K are processed by the complement 505 and complement 506 respectively. Assuming that, as is usual in digital logic systems, the values of K and 1/K are coded as in binary digit form. The result of the complement operation are the decimal values 1-K and 1-1/K. The curve decoder 501 decodes the curve type number S onto two output lines for curve types 2 and 3. In response to a curve type 2 signal, the data select 507 transfers the value 1-1/K to one input of the multiplier 509. In response to curve type 3 signal, the data select 507 transfers the value 1-K to the multiplier 509. For curves types 1 and 4, a zero value is transferred to multiplier 509. Multiplier 509 multiplies the data transferred by the data select 507 by the value of M transferred by the data select 522. The product data is furnished as one of the data inputs to the adder 115.

Figure 7:
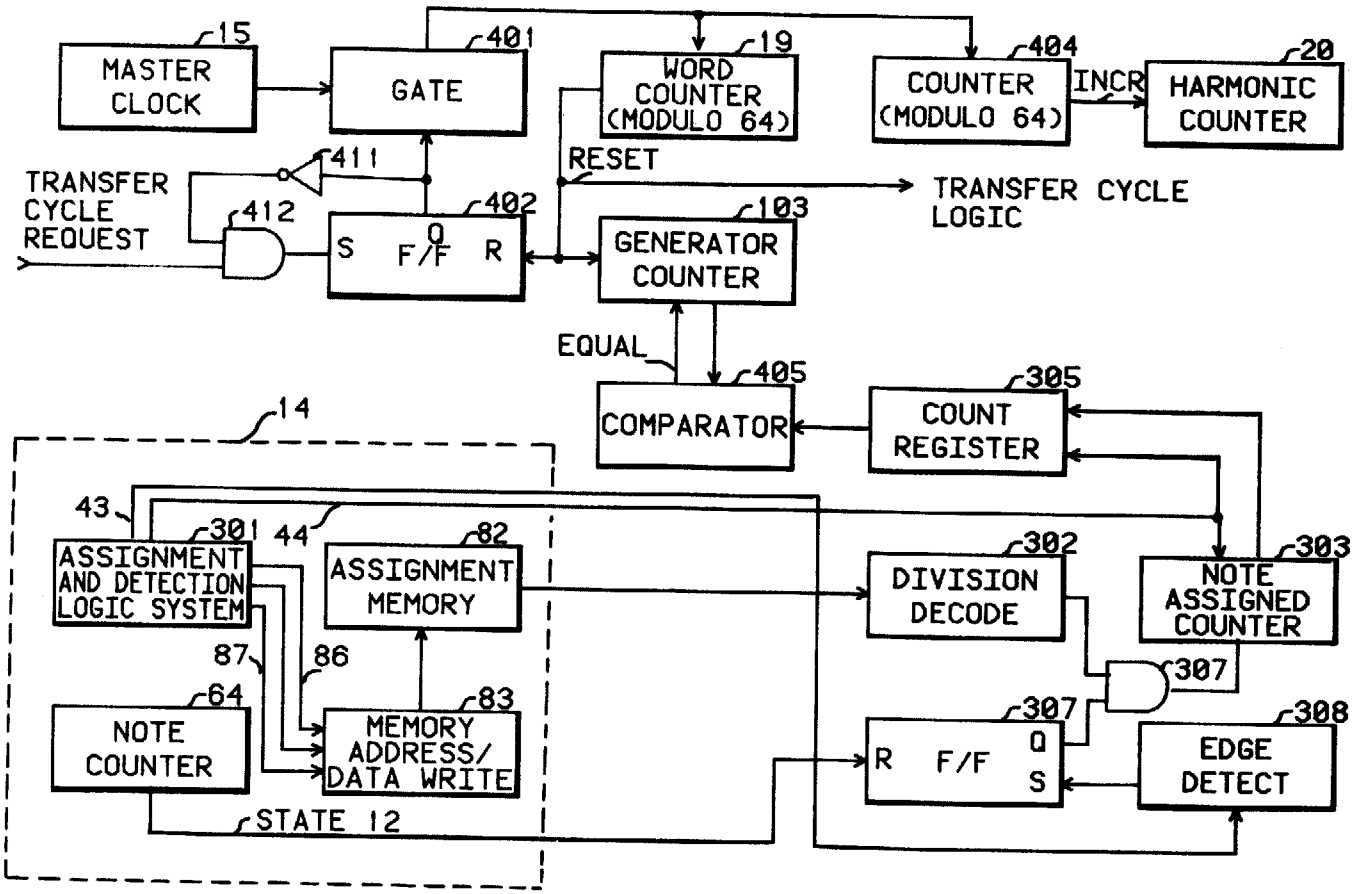
FIG. 7 is a schematic diagram of the executive control circuit of FIG. 1.

FIG. 7 shows the detailed system logic of the executive control 16. For the preferred embodiment the generator counter 103 is used only to generate computation cycle segments equal to the number of assigned tone generators in a selected keyboard. For illustrative purposes, the upper keyboard is selected. Extensions are readily made to other keyboards or combinations of keyboards.

A complete computation cycle consisting of a sequence of computation cycle segments is initiated, or started, when flip-flop 402 is set so that its output logic state is Q="1". Flip-flop 402 can be set if a transfer cycle request has been received by the AND-gate 412 and if at this time the flip-flop 402 is in its reset condition with a logic state Q="0". Transfer cycle requests are generated by the logic block Synch. Bit Detector 39 shown in FIG. 1 of the referenced U.S. Pat. No. 4,085,644.

When flip-flop 402 is set, the output logic state Q="1" causes gate 401 to transmit timing signals from the master clock 15 which are used to increment the count state of the word counter 19 and the counter 404. Counter 404 is implemented to count modulo 64. Each time counter 404 returns to its initial count state, because of its modulo counting implementation, an INCR signal is created. The INCR signal is used to increment the count state of the harmonic counter 20.

When the word counter 19 is reset to its initial state, because of its modulo counting implementation, a RESET signal is generated. This RESET signal is used to increment the count state of the generator counter 103. The same RESET signal is used to reset the flip-flop 402. The resetting of the flip-flop 402 denotes the termination of a computation cycle segment. The RESET signal from the word counter 19 can be used to initiate the transfer cycle of a master data set to a tone generator corresponding to a numerical designation which is one less than the count state of the generator counter 103.

The dashed outline of the note detect and assignor 14 contains an assignment and detection logic system 301. One of the functions of this system is to generate a signal on line 42 when the keyswitch states on the upper keyboard are examined; to generate a signal on line 43 at a later time when the keyswitch states on the lower keyboard are examined; and to generate a signal on line 44 when the keyswitch states on the pedal, or third keyboard, are examined. A signal is generated on line 86 if a keyswitch state has changed since the previous keyboard scan and is now in its unactuated state. A signal is generated on line 87 if a keyswitch state has changed since the previous keyboard scan and is now in its actuated state.

Each time that the assignment and detection system 301 finds a change in a state of a keyswitch, the contents of the assignment memory 82 are addressed out to examine the stored data. The data is addressed out by means of the memory address/data write 83. The data words stored in the assignment memory are composed of 10 bits. The least significant bit will be a "1" if the corresponding tone generator has been assigned. Each stored word has a corresponding tone generator which uses the data to perform its tone generation function. Bits 2–4 denote the octave of the actuated keyswitch; bits 5–6 denote the keyboard; and bits 7–10 denote the note within the musical octave.

When a signal appears on line 44, the note assigned counter 303 is initialized to a zero value after its count state is transferred to the count register 305. The division decode 302 generates a signal each time a data word is addressed out of the assignment memory which has a keyboard code of "01" which corresponds to the upper keyboard. AND-gate 307 will transfer a signal to incremant the count state of the note assigned counter 301 if the flip-flop 307 is set and a data word has been read out from the assignment memory 82 corresponding to the upper keyboard.

When a signal appears on line 43, the scanning of the keyswitch states on the upper keyboard has been completed. The signal on line 43 is converted to a pulse-like signal by the edge detect 308 and the result is used to set the flip-flop 307. When the flip-flop 307 is set, the AND-gate 307 will transfer the signals generated by the division decode 302 to increment the count state of the note assigned counter 303. When the note counter 64 is incremented to its count state 12, as described in the referenced U.S. Pat. No. 4,022,098, a signal is generated which is used to reset the flip-flop 307. The net result is that the count state of the note assigned counter 303 is equal to the number of tone generators that have been assigned to the upper keyboard. This number is transferred to the count register 305 when the scan starts for the third keyboard as detected by a signal on line 44.

The comparator 405 compares the count state of the generator counter 103 with the number of assigned tone generators contained in the count register 305. When the two numbers are equal, an EQUAL signal is generated which is used to reset, or initialize, the state of the generator counter 103. In this fashion, the number of computation cycle segments used to generate time varying harmonics is made equal to the number of tone generators assigned to the upper keyboard as a result of keyswitch closures.

Figure 8:
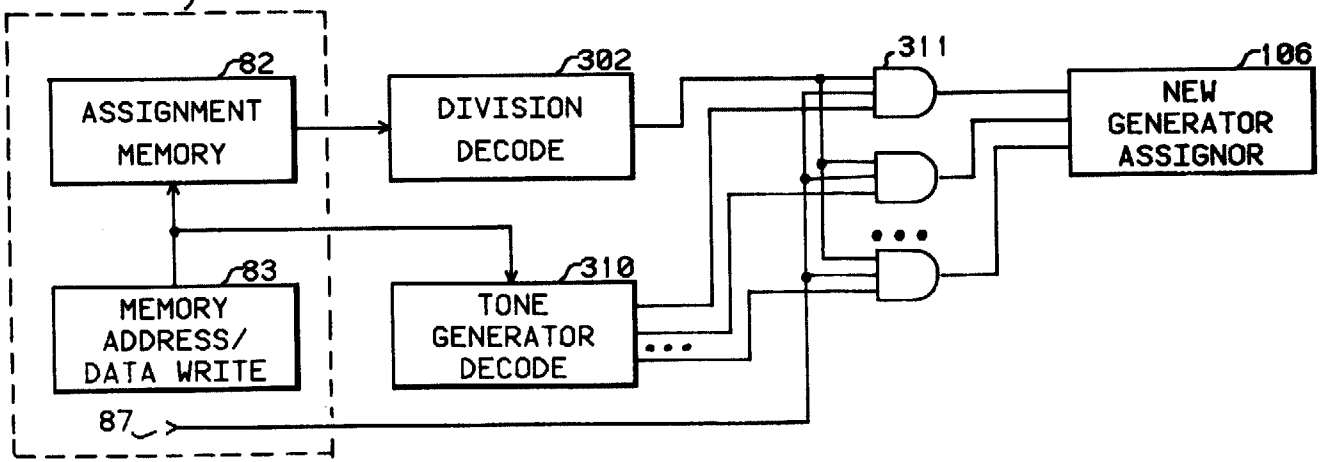
FIG. 8 is a schematic diagram of the new generator assignor input data generator of FIG. 4.

FIG. 8 illustrates the logic for generating the input data for the new generator assignor 106 shown in FIG. 4. As data is read out of the assignment memory 82, the division decode 302 will transfer data corresponding to the assigned upper keyboard tone generators to the set of select gates 311. The tone generator decode 310 decodes the memory addressing data from the memory address/data write onto 12 lines connected to the set of select gates 311. A signal on line 87 denotes that a new switch closure has been detected. In this manner an output from the select gate 311 will occur if a new keyswitch closure has been detected for the upper keyboard.

The present invention can readily be incorporated into other tone generator systems in which a Fourier-type transform is implemented to generate a musical wave shape from a stored set of harmonic coefficients. Such a system is described in U.S. Pat. No. 3,809,786 entitled "Computor Organ." This patent is hereby incorporated by reference.

Figure 9:
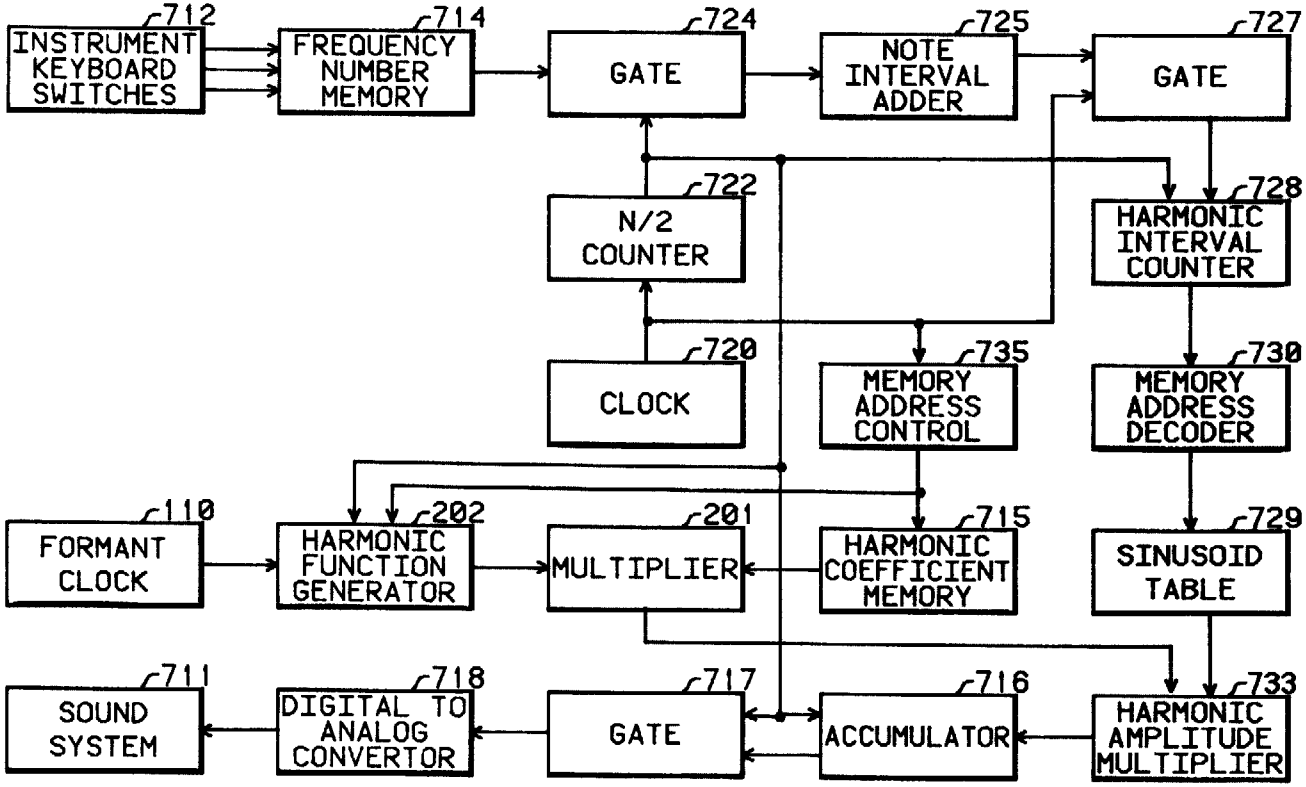
FIG. 9 is a schematic diagram of an alternative embodiment of the invention.

FIG. 9 illustrates how the present invention can be incorporated into the Computor Organ to produce independent time varying harmonics. The seven hundred series numbers correspond to 700 plus the block labels shown in FIG. 1 of the U.S. Pat. No. 3,809,786. The addition of the subsystem indicated by the harmonic function generator 202 and the multiplier 201 will create the independent time-varying harmonic tones.

I claim:

1. In a keyboard musical instrument having a number of tone generators, in which a plurality of data words corresponding to the amplitudes of a corresponding number of evenly spaced points defining the waveform of a musical tone are computed during a sequence of computation cycles and are transferred sequentially to a digital-to-analog converter at a rate proportional to the pitch of the tone being generated, apparatus for generating tones having independent time-varying harmonic components comprising:

a coefficient memory for storing a set of harmonic coefficient values, a first addressing means for reading out harmonic coefficient values from said coefficient memory, a formant clock for providing a sequence of format timing signals a curve memory for storing a plurality of sets of curve parameter values wherein each set of said sets of curve parameter values corresponds to one of said harmonic coefficient values, a first addressing means wherein a harmonic address signal is generated and whereby a harmonic coefficient value corresponding to said address signal is read out from said coefficient memory, a parameter addressing means responsive to said harmonic address signal whereby a plurality of curve parameter values is read out sequentially from said curve memory in response to said sequence of formant timing signals wherein said read out plurality of curve parameter values are from a set of curve parameter values corresponding to said harmonic address signal, a harmonic scale factor generation means whereby a sequence of harmonic scale factors are computed recursively in response to said parameter values read out sequentially from said curve memory to produce a sequence of time variant harmonic scale factor values corresponding to said harmonic address signal, a first multiplier means wherein said read out harmonic coefficient value is multiplied by said sequence of time variant harmonic scale factor values thereby producing a sequence of time variant harmonic coefficient values corresponding to each harmonic coefficient value read out from said coefficient memory, a means for computing, responsive to said sequence of time variant harmonic coefficient values corresponding to each harmonic coefficient value read out from said coefficient memory, whereby a master data set defining said waveform of a musical tone is generated during each one of said sequence of computation cycles, and a means for producing musical tones from said master data set having said independent time-varying harmonic components.

2. In a musical instrument according to claim 1 wherein said means for computing comprises:

a word counter incremented at each computation time in each computation cycle of said sequence of computation cycles and wherein said word counter counts modulo the number of data values comprising said master data set, modulo reset circuitry whereby a word reset signal is created when said word counter returns to its initial state, a harmonic counter incremented by said word reset signal, a sinusoid table storing values of trigonometric functions, an adder-accumulator means initialized at the start of each computation cycle of said sequence of computation cycles for successively adding and storing the contents of said harmonic counter, a second addressing means for reading out trigonometric function values from said sinusoid table in response to contents stored in said adder-accumulator means, a first memory means for storing data to be thereafter read out, a second multiplier means for generating the multiplied product of said time variant harmonic coefficient values and said trigonometric function values read out from said sinusoid table, a means for successively algebraically summing said multiplied product with data values read out from said first memory means in response to contents of said word counter to form a summed value, and a third addressing means responsive to contents of said word counter whereby said summed value created by said means for successively algebraically summing is stored in said first memory means.

3. In a musical instrument according to claim 2 wherein said means for producing musical tones comprises:

a plurality of tone generators each comprising a note memory means for storing data to be thereafter read out, a data transfer means whereby data values stored in said first memory means is read out and stored in one of said note memory means, a plurality of note addressing means, each associated with a corresponding one of said note memory means, for sequentially and repetitively reading out data stored in each of said note memory means, and means for producing musical waveshapes from data read out of said note memory means.

4. In a musical instrument having a number of tone generators in which a plurality of data words corresponding to the amplitudes of a corresponding number of evenly spaced points defining the waveform of a musical tone are computed during each one of a sequence of computation cycles and are transferred sequentially to a digital-to-analog converter at a rate proportional to the pitch of the tone being generated, apparatus for generating tones having independent time-varying harmonic components comprising:

a coefficient memory for storing a set of harmonic coefficient values, a formant clock for providing a sequence of formant timing signals, a first memory means, comprising a plurality of a number of P harmonic scale value memories a second memory means comprising a plurality of phase memory means for storing values of a curve type parameter S and where each of said pluralty of phase memory means corresponds to one of said plurality of harmonic scale value memories, a third memory means comprising a plurality of K-value memory means for storing values of a first curve parameter value K and a second curve parameter value M and where each one of said plurality of K-value memory means corresponds to one of said plurality of harmonic scale value memories, a word counter incremented at each computation time in each computation cycle in said sequence of computation cycles and wherein said word counter counts modulo said number of evenly spaced points defining the waveform of a musical tone and wherein a word reset signal is created when said word counter returns to its initial count state, a harmonic counter incremented by said word reset signal a first addressing means responsive to contents of said harmonic counter for reading out values of the curve type parameter S from said second memory means and for reading values of the first curve parameter value K and a second curve parameter value M from said third memory means, a second addressing means responsive to the content of said harmonic counter for reading out a harmonic scale factor from said first memory means and which is designated by the letter A, an amplitude computation means responsive to said read out curve type parameter S, said read out first curve parameter value K, and said read out second curve parameter value M for computing a new harmonic scale factor A' in response to said harmonic scale factor A, and a third addressing means responsive to the contents of said harmonic counter for storing said new harmonic scale factor A' in said first memory means a fourth addressing means responsive to the content of said harmonic counter whereby a harmonic coefficient value is read out from said coefficient memory, a first multiplier means whereby said read out harmonic coefficient value is muliplied by said new harmonic scale factor A' to produce a time variant scaled harmonic coefficient, a means for computing, responsive to each said time variant scaled harmonic coefficient corresponding to the content of said harmonic counter, whereby a master data set defining said waveform of a musical tone is generated during each one of said sequence of computation one of said plurality of harmonic scale value memories, a third memory means comprising a plurality of K-value memory means for storing values of a first curve parameter value K and a second curve parameter value M and where each one of said plurality of K-value memory means corresponds to one of said plurality of harmonic scale value memories, a word counter incremented at each computation time in each computation cycle in said sequence of computation cycles and wherein said word counter counts modulo said number of evenly spaced points defining the waveform of a musical tone and wherein a word reset signal is created when said word counter returns to its initial count state, a harmonic counter incremented by said word reset signal a first addressing means responsive to contents of said harmonic counter for reading out values of the curve type parameter S from said second memory means and for reading values of the first curve parameter value K and a second curve parameter value M from said third memory means, a second addressing means responsive to the content of said harmonic counter for reading out a harmonic scale factor from said first memory means and which is designated by the letter A, an amplitude computation means responsive to said read out curve type parameter S, said read out first curve parameter value K, and said read out second curve parameter value M for computing a new harmonic scale factor A' in response to said harmonic scale factor A, and a third addressing means responsive to the contents of said harmonic counter for storing said new harmonic scale factor A' in said first memory means a fourth addressing means responsive to the content of said harmonic counter whereby a harmonic coefficient value is read out from said coefficient memory, a first multiplier means whereby said read out harmonic coefficient value is multiplied by said new harmonic scale factor A' to produce a time variant scaled harmonic coefficient, a means for computing, responsive to each said time variant scaled harmonic coefficient corresponding to the content of said harmonic counter, whereby a master data set defining said waveform of a musical tone is generated during each one of said sequence of computation cycles, and a means for producing musical tones from said, master data set having said independent time-varying harmonic components.

5. In a musical instrument according to claim 4 wherein said amplitude computation means comprises:

a recursive computation means whereby said new harmonic scale factor A' is evaluated from said harmonic scale factor A according to the relation $A'=K'A+N$ where N and K' are constants depending upon said first curve parameter value K and said second curve parameter value M.

6. In a musical instrument according to claim 5 wherein said recursive computation means comprises:

N-compute circuitry means responsive to said curve type parameter S read out of said second memory means, said first curve parameter value K read out from said third memory means, and said second parameter value M read out from said third memory means whereby the value of said constant N is computed according to the relations:

$N=0$ if $S=1$ $N=M(K-1)K$ if $S=2$ $N=M(1-K)$ if $S=3$ $N=0$ if $S=4$, and

K-compute circuitry responsive to said curve type parameter S read out from said second memory means and said first curve parameter value K read out from said third memory means whereby the values of said constant K' are computed according to the relations:

$K'=K$ if $S=1$ or $S=3$ $K'=1/K$ if $S=2$ or $S=4$.

7. In a musical instrument according to claim 5 wherein said amplitude computation means further comprises:

a generator counter incremented at the start of each one of said computation cycles, an output data select means, responsive to the count state of said generator counter, whereby a harmonic scale factor A is selected from data read out from said first memory means corresponding to said count state, and an input data select means, responsive to the count state of said generator counter whereby said new harmonic scale factor A' is stored by said sixth addressing means one of said plurality of harmonic scale value memories corresponding to said count state.

8. In a musical instrument according to claim 7 wherein said amplitude computation means further comprises:

a plurality of segment counters equal in number to said number P, counter addressing circuitry for reading out the count state of a member of said plurality of segment counters corresponding to the count state of said generator counter, a fourth memory means comprising a number P of endpoint memory means storing values of an endpoint constant $A_o$, an endpoint addressing means responsive to the count state of said plurality of segment counters read out by said counter addressing circuitry whereby an endpoint constant $A_o$ is read out of an endpoint memory means corresponding to the count state of said generator counter, a comparator means whereby an equal signal is generated if said harmonic scale factor A, selected by said output data select means, is equal to the value of said endpoint constant $A_o$ read out of said fourth memory means, an endpoint data select means whereby said endpoint constant $A_o$, read out of said fourth memory means, is selected in response to said equal signal and whereby said harmonic scale factor A, selected by said output data select means, is selected if said equal signal is not generated by said comparator means, and an adder means whereby the count state of a member of said plurality of segment counters corresponding to the count state of said generator counter is incremented in response to said equal signal.

9. In a musical instrument according to claim 8 wherein said amplitude computation means further comprises:

a latch for generating a latch signal in response to said sequence of timing signals if said harmonic counter is in its initial count state and whereby said latch signal is not generated when said harmonic counter is reset to its initial count state, and selection circuitry responsive to said latch signal whereby said new harmonic scale factor A′ is transferred as the harmonic scale factor input to said endpoint data select means and whereby if said latch signal is not generated said harmonic scale factor A is transferred as the harmonic scale factor input to said endpoint data select means.

10. In a musical instrument according to claim 9 wherein said amplitude computation means further comprises:

an array of keyboard switches, a detection means for detecting the actuated key states of said keyboard switches, an assignment means for assigning members of said number of tone generators to actuated key states detected by said detection means, and initializing means whereby contents of said plurality of segment counters corresponding to said assigned member of said number of tone generators are initialized and whereby contents of said plurality of amplitude memory means corresponding to said assigned member of said number of tone generators are initialized.

11. In an electronic musical instrument of the type wherein musical tones are synthesized in real time, said instrument having generation means for individually evaluating the constituent Fourier components of a musical waveshape, the relative amplitudes of said Fourier components with respect to each other being established by a set of harmonic coefficients stored in said generation means, an accumulator for accumulating these components to obtain the successive sample point amplitudes of said musical waveshape, and a converter connected to said accumulator for converting said amplitudes to musical tones, apparatus for generating tones having independent time-varying harmonic components comprising:

a coefficient memory for storing a set of harmonic coefficient values, a formant clock for providing a sequence of formant timing signals, a curve memory for storing a plurality of sets of curve parameter values where each one of said set of curve parameter valyes corresponds to one harmonic coefficient value in said set of harmonic coefficient values, a first address means wherein a harmonic address signal is generated and whereby a harmonic coefficient value corresponding to said harmonic address signal is read out from said coefficient memory, a parameter addressing means responsive to said harmonic address signal whereby a corresponding one of said plurality of parameter values is read out sequentially from said curve memory in response to said sequence of timing signals, a harmonic scale factor generation means whereby a sequence of harmonic scale factors are computed recursively in response to said parameter values read out sequentially from said curve memory to produce a sequence of time variant harmonic scale factor values corresponding to said harmonic address signal, a first multiplier means wherein said read out harmonic coefficient is multiplied by said sequence of time variant harmonic scale factor values thereby producing a sequence of time variant harmonic coefficient values corresponding to each harmonic coefficient value read out from said coefficient memory, a means for individually evaluating said constituent Fourier components in response to said time variant harmonic coefficient values, and a tone generating means for producing musical tones from said constituent Fourier components.

* * * * *